US006651961B1

(12) United States Patent
Meyer

(10) Patent No.: US 6,651,961 B1
(45) Date of Patent: Nov. 25, 2003

(54) MULTIPLE LOAD BLOCKS FOR A CRANE

(76) Inventor: William D. Meyer, 3407 Waters Edge Dr., Sugar Land, TX (US) 77478

( * ) Notice: Subject to any disclaimer, the term of this patent is extended or adjusted under 35 U.S.C. 154(b) by 0 days.

(21) Appl. No.: 09/503,430

(22) Filed: Feb. 14, 2000

(51) Int. Cl.[7] ..... B66D 1/36
(52) U.S. Cl. ..... 254/337; 254/285; 254/399
(58) Field of Search ..... 254/284, 285, 254/286, 337, 336, 399

(56) References Cited

U.S. PATENT DOCUMENTS 3,854,592 A * 12/1974 Mordre ..... 254/337
3,967,735 A * 7/1976 Payne ..... 254/284
4,010,852 A 3/1977 Goss et al.
4,227,676 A 10/1980 Vaillant et al.
4,277,053 A 7/1981 Simon
4,951,924 A * 8/1990 Calkins ..... 254/337
5,579,931 A * 12/1996 Zuehlke et al. ..... 254/285

* cited by examiner

*Primary Examiner*—Emmanuel Marcelo
(74) *Attorney, Agent, or Firm*—Kenneth A. Keeling; James E. Hudson, III

(57) ABSTRACT

A multi-block rigging system for a heavy crane, pulling or lifting device. The system uses sheave blocks in series orientation to enable the use of standard, economical or preferred, size winch drums and standard, economical or preferred, diameter and length wire rope, each forming a separate set of reeving lines. Each set of reeving lines moves its corresponding load block a proportional distance of the total travel length for the load hook. Alternatively, different line parts of line for each reeved set enables different travel speeds of the load block for different capacity requirements.

13 Claims, 7 Drawing Sheets

– Prior Art –

- Prior Art -

- Prior Art -

MULTIPLE LOAD BLOCKS FOR A CRANE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This invention relates to a system of hoisting blocks for heavy cranes and hoisting devices. Specifically, the invention describes a system of load blocks connected in series to enable heavy lifts to be conducted with standard/conventional winch drums and hoist lines that by conventional rigging, would not be able to provide the capabilities of combined lift capacity and hoisting height.

2. Related Art

The art of rigging and developing mechanical lifting advantage using pulleys has long been known. The development of heavy capacity cranes, however, has changed the load demands on load lines and reeved systems. Heavy capacity cranes have the mechanical and structural ability to lift heavy loads, but the strength of the load line, the winches' maximum line pull and the capacity of the drums to hold sufficient wire rope are often limiting factors. In addition, load blocks reeved for heavy lifts are restrictive in hoisting speed, and those reeved for speed for lift are limited in lift capacity. One way to overcome these limitations is the use of oversized high strength wire rope. The use of oversized wire rope poses operational problems. Since it is thicker and heavier than conventional wire rope, high strength wire rope requires large capacity hoisting drums and sheaves for adequate wrapping, is difficult to handle during set-up and rigging due to its weight and inflexibility, may require special linear winches, and is more expensive than conventional wire rope.

The typical alternative to the use of oversized wire rope by heavy cranes is the use of multiple part reeving, which uses standard strength wire rope. Multiple part reeving distributes the weight of the load over multiple parts of the wire rope. Heavy capacity cranes typically use double load lines operating in parallel, each line having a dedicated set of boom and load block sheaves forming distinct reeving systems.

Heavy capacity cranes typically have long booms, to be able to lift tall objects, have a long horizontal reach, and/or have a high vertical reach. Boom lengths over 300 meters are becoming more common. If standard wire rope is used, the long boom length of the high capacity crane, combined with the reeving requirements to support a heavy load, require long lengths of standard load line. The amount of line required is at least the length of the boom plus that length multiplied by the number of parts in the multiple reeving. Thus, a boom with a 100-meter boom and an eight part reeving from each drum requires a total of 900 meters of wire rope for each load line. Spooling this length of line requires special handling equipment for the wire rope, including a large capacity hoist drum. It would be a new and useful improvement over the prior art for a hoisting system be capable of using standard wire rope and standard size hoist drums in a high capacity crane. It is understood that there are many sizes of wire rope and hoist drums. However, the term "standard" is nonetheless used to denote sizes that are economical and are not oversized. Also, the words "winch drum" are used herein to describe a mechanical means of applying a tensile (pulling) force to a wire rope or other flexible tensile load support mechanism, and is intended to cover other means of applying the pulling force, such as a linear winch, hydraulic jacks and so forth.

BRIEF SUMMARY OF THE INVENTION

Accordingly, the objectives of this invention are to provide, inter alia, a new and improved load block system for heavy cranes and lifting devices that:

- uses standard size (i.e. economical sized) wire rope for the load line;
- uses standard size (i.e. economical sized) hoisting drums;
- uses standard boom sheaves and load block sheaves;
- enables light capacity with high hoist speed and heavy capacity with low hoist speeds all with the one reeving arrangement;
- enables large capacity lifts on long boom lengths with hoisting equipment that was previously designed for shorter boom lengths only; and
- is interchangeable between cranes.

These objectives are addressed by the structure and use of the inventive multiple load block system. Multiple load block sheaves are vertically oriented in series, each forming distinct sets of reeving lines between lower load block sheaves and upper sheaves or attachment points. This orientation only requires each set of sheaves to move vertically through a proportional percentage of the total vertical height of the boom tip. The use of multiple load blocks vertically oriented in series allows the use of standard sized winch drums, since each set of reeving lines must only traverse a portion of the total travel distance of the load hook. If the number of parts of line in the reeving lines is different, then the different reeving line sections afford different travel speeds. In addition, both high capacity lifts at slow speeds and lower capacity lifts at higher speeds can be effected by the use of this system. As an example, consider a two part reeved system in series with the top set of reeving being reeved for heavy lifts (many parts of line) and the lower set of reeving being reeved for light lifts (few parts of line). When light lifting duties are required, the bottom set of reeving will be run up and down at a resulting high speed, providing a good cycle time. When a heavy lift is required, first the lower and middle set of blocks will be lowered down to the ground, then interconnecting steel link plates will be connected between the lower and middle blocks, effectively bypassing the lower system (and removing the weak link) and then the upper system of reeving will be used for the heavy lift.

Other objects of the invention will become apparent from time to time throughout the specification hereinafter disclosed.

DETAILED DESCRIPTION OF THE INVENTION

The present invention is described as system 10, which comprises at least one upper rigging unit 100 and one lower rigging unit 300, each rigging unit comprising boom head sheaving, traveling sheave blocks and load lines. Winch drums, hook, boom and power drives typically are associated with heavy crane 15 and the operation of system 10 as described in this disclosure.

Figure 1:
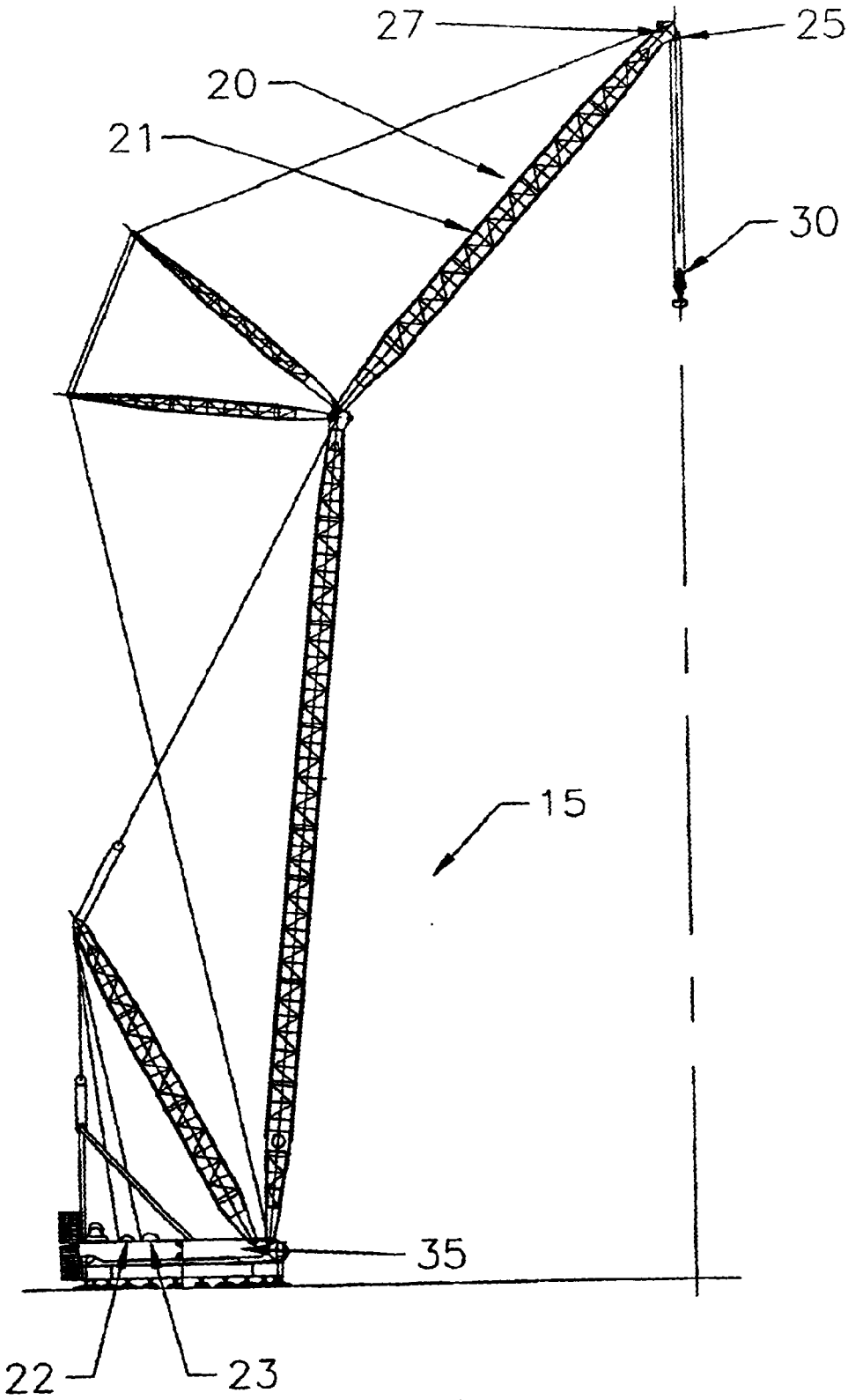
FIG. 1 depicts a prior art heavy crane with a single hook block.
Figure 2:
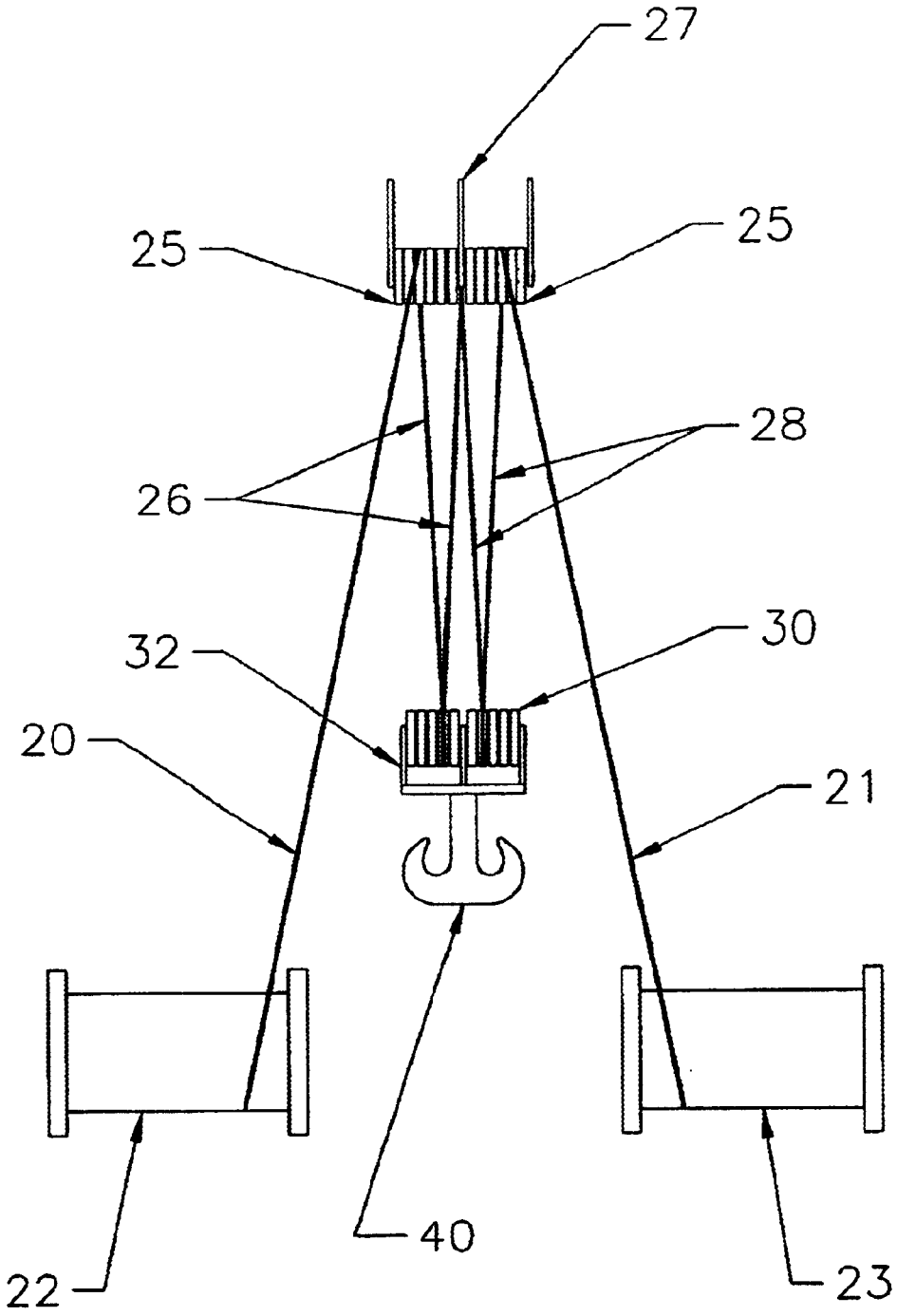
FIG. 2 depicts prior art double-line single-block reeving.

Prior art for block rigging for heavy crane 15 is shown in FIG. 1 and FIG. 2. For purposes of clarity, reeving may be illustrated as two part reeving. It is understood, however, that typically reeving comprises multiple line parts numbering greater than two. To support heavy loads, heavy cranes typically use a double-line reeving system operating in parallel, as shown in FIG. 2. First main hoist line 20 and second main hoist line 21 reeve over boom head sheaves 25 and reeve down to load block sheaves 30, forming first reeving lines 26 and second reeving lines 28. First reeving lines 26 and second reeving lines 28 terminate their dead ends at load block 32 if the number of reeving line parts are odd, or typically at boom tip 27 if the number of reeving line parts are even.

The load (not shown) attached to hook 40 is supported by the combination of first reeving lines 26 and second reeving lines 28. First reeving lines 26 are formed by first main hoist line 20, which is payed in and out from first winch drum 22 mounted on body 35 of heavy crane 15, shown in FIG. 1. Second reeving lines 28 are formed by second main hoist line 21, which is payed in and out from second winch drum 23 in payed line length synchrony with main hoist line 20. This synchrony (and equal parts of line in each first reeving lines 26 and second reeving lines 28) assures an even vertical travel of load block 32, which is typically supported equally by both first reeving lines 26 and second reeving lines 28. The synchronization is achieved by connective, mechanical and/or electrical coordination of the rotation of first winch drum 22 and second winch drum 23.

Figure 3:
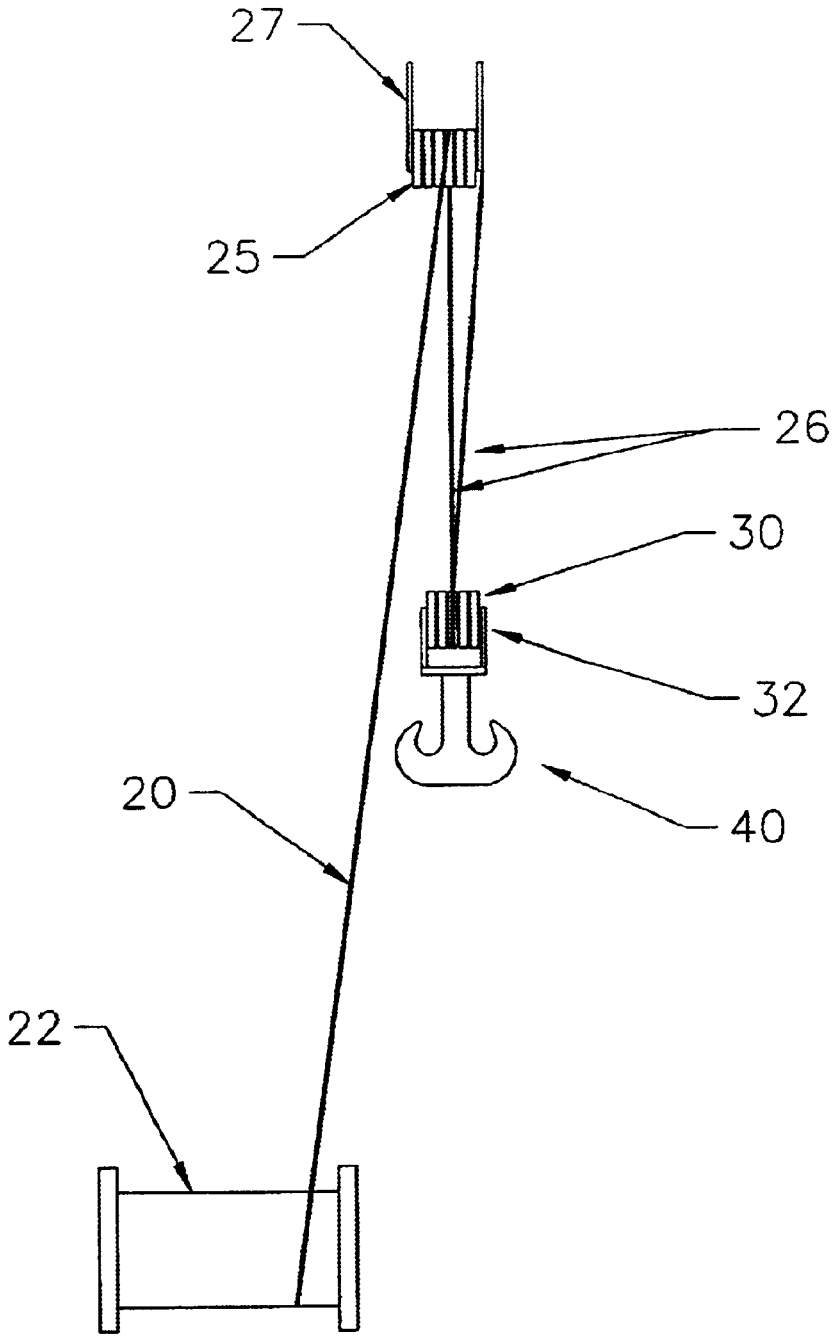
FIG. 3 depicts prior art single-line single-block reeving.

Alternatively, prior art reeving using a single load line 20 is depicted in FIG. 3. First main hoist line 20 pays in and out from first winch drum 22, forms first reeving lines 26 by reeving over boom head sheaves 25, down and under load block sheaves 30, and terminating at boom tip 27 or load block 32, depending on the number of reeving line parts. Single load line reeving is typically used for lighter load duty lifts.

The present invention system 10 is shown in FIGS. 4–7. In a first embodiment having a double series reeved system, depicted in FIG. 4 and FIG. 5, there are two traveling load blocks, shown as upper load block set 132 and lower load block 332. It is understood, however, that the number of traveling load blocks can be more than two, the number limited only by the number of winch drums available and physical constraints of the body 35 and boom 17. Each load block is supported and moved by at least two rigging means operating in parallel, each having a winch drum, load line, and upper and lower sheaves.

Figure 5:
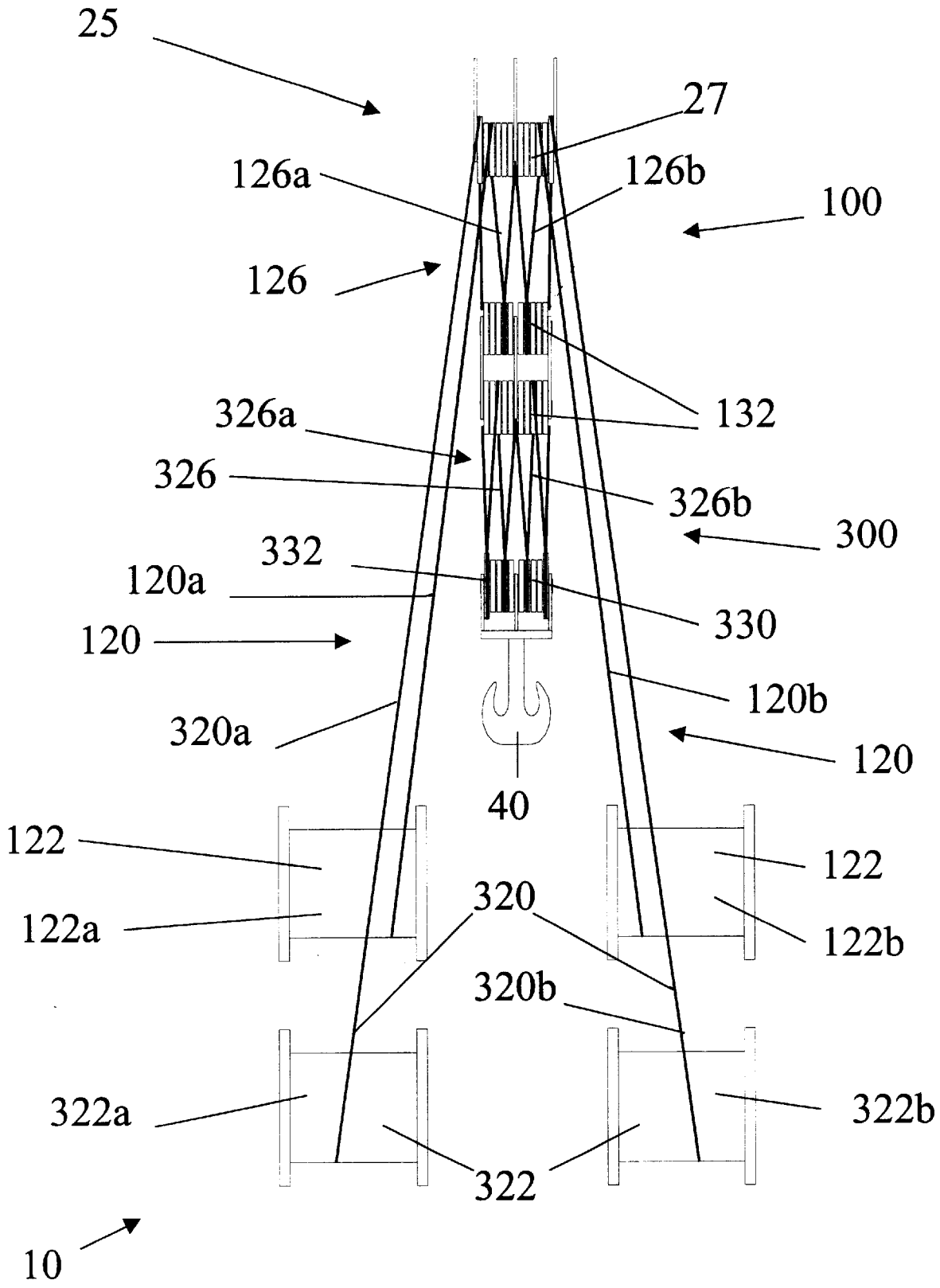
FIG. 5 depicts the preferred embodiment of the inventive multiple-line multiple-block reeving.

In FIG. 5, upper rigging unit 100 is defined by two upper load lines 120 forming upper reeving lines 126 that reeve over the boom head sheaving of boom head sheaves 25, down to and under upper load block sheaves 130, and terminate at a termination point, typically boom tip 27 if there are an even number of line parts in upper reeving lines 126. If upper reeving lines 126 have an odd number of line parts, upper reeving lines 126 terminate at upper load block set 132. Upper load line 120 is payed in and out from upper winch drums 122, which are physically, mechanically or electrically synchronized to pay upper load lines 120 in and out at the same rate.

Lower rigging unit 300 is defined by lower load lines 320 forming lower reeving lines 326 that reeve over boom head sheaves 25, down to lower load block sheaves 330 and up to the load block sheaves in upper load block set 132, and terminate at a lower reeving line 326 termination point, that point typically being upper load block set 132 if there are an even number of line parts in lower reeving lines 326. If there are an odd number of parts of reeving line, lower reeving lines 326 terminate at lower load block 332. Lower load line 320 is payed in and out from lower winch drums 322, which are physically, mechanically or electrically synchronized to pay lower load lines 320 in and out at the same rate.

Figure 6:
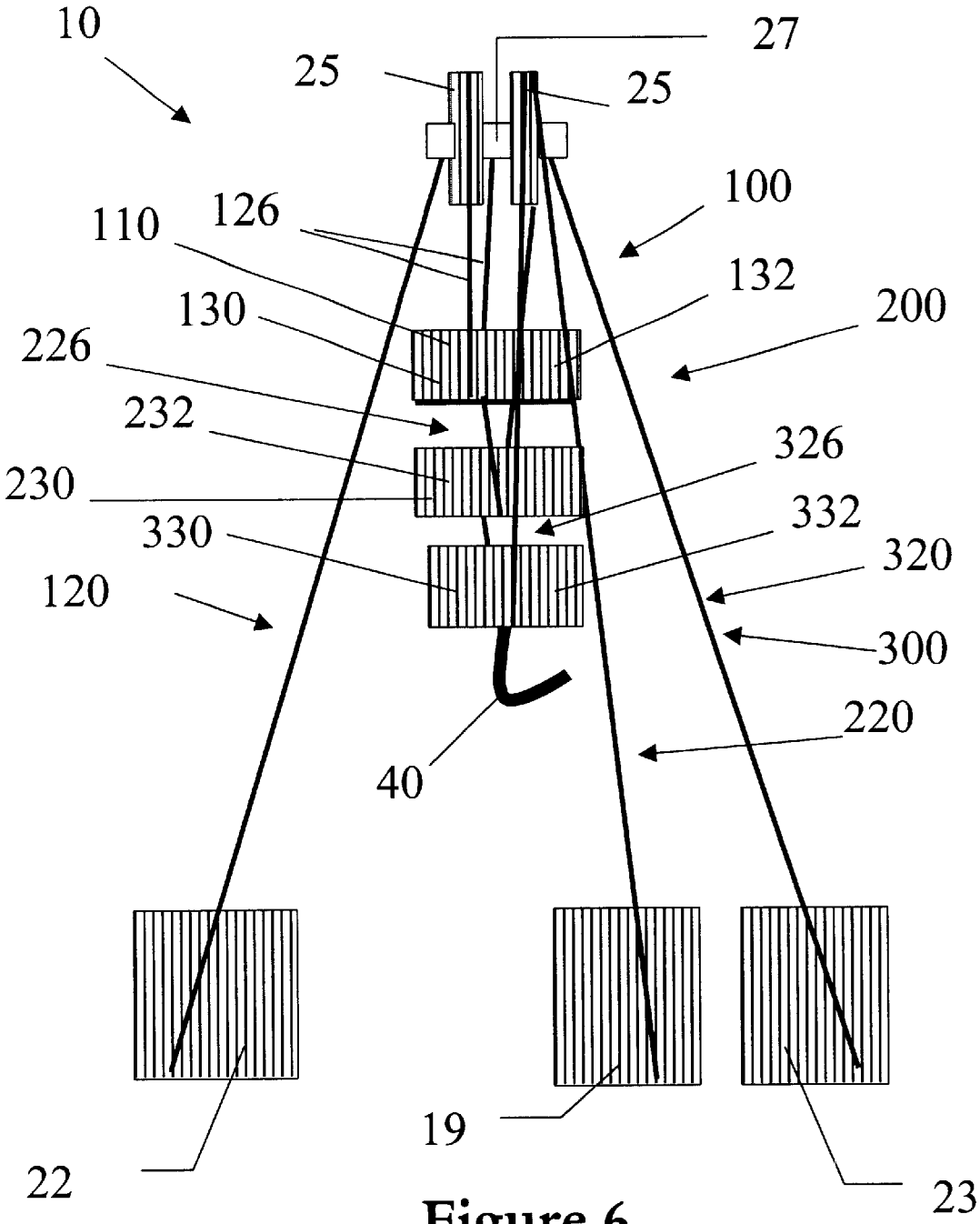
FIG. 6 depicts the preferred embodiment of the invention showing a single-line multi-block rigging having at least three traveling blocks.

As seen in FIG. 6, system 10 can incorporate intermediate rigging unit 200, defined by intermediate load lines 220 reeving over boom head sheaves 25, down to intermediate load block set 232 having intermediate load block sheaves 230 and up to higher adjacent load block sheaves 110, and terminating at an intermediate reeving line 226 termination point. Higher adjacent load block sheaves 110 are upper load block sheaves 130 when intermediate load block set 232 is the only intermediate load block set 232, or is the uppermost intermediate load block set 232 in a plurality of intermediate load block sets 232. When a lower intermediate load block set 232 is of a plurality of intermediate load block sets 232 and is not the uppermost intermediate load block set 232, higher adjacent load block sheaves 110 are the intermediate load block sheaves 230 higher and adjacent to the lower intermediate load block set 232. Where there are an even number of reeving parts in intermediate reeving lines 226, the termination point for intermediate reeving lines 226 is a higher positioned intermediate load block set 232, unless intermediate load block set 232 is the uppermost intermediate load block set 232, wherein the attachment point for its intermediate reeving lines 226 is upper load block set 132. If there are an odd number of reeving parts of line, intermediate reeving lines 226 terminate at the intermediate load block set 232 being supported by those intermediate reeving lines 226.

Further depicted in FIG. 6, lower load block 332 reeves to the lowest intermediate load block set 232. Lower load lines 320 reeve over boom head sheaves 25, down to and under lower load block sheaves 330 and up to the lowest intermediate load block sheaves 230. Lower reeving lines 326, formed by lower load lines 320, terminate either at lower load block 332 or the lowest intermediate load block set 232, depending on the number of parts of line in lower reeving lines 326.

For the sake of clarity, FIG. 6 depicts each rigging unit having a single load line. It is understood, however, that in the preferred embodiment, multiple load lines analogous to those depicted in FIG. 5 are used to provide additional strength to the reeving lines. Further, each sheave set shown may be split into two parallel interconnected sets of sheaves in the vertical plane. That is, the vertical systems of reeving and block sets shown in the FIG. 5 can be duplicated to provide multiple planes of reeved sets to provide additional parallel lifting systems supported from the single boom head.

Figure 7:
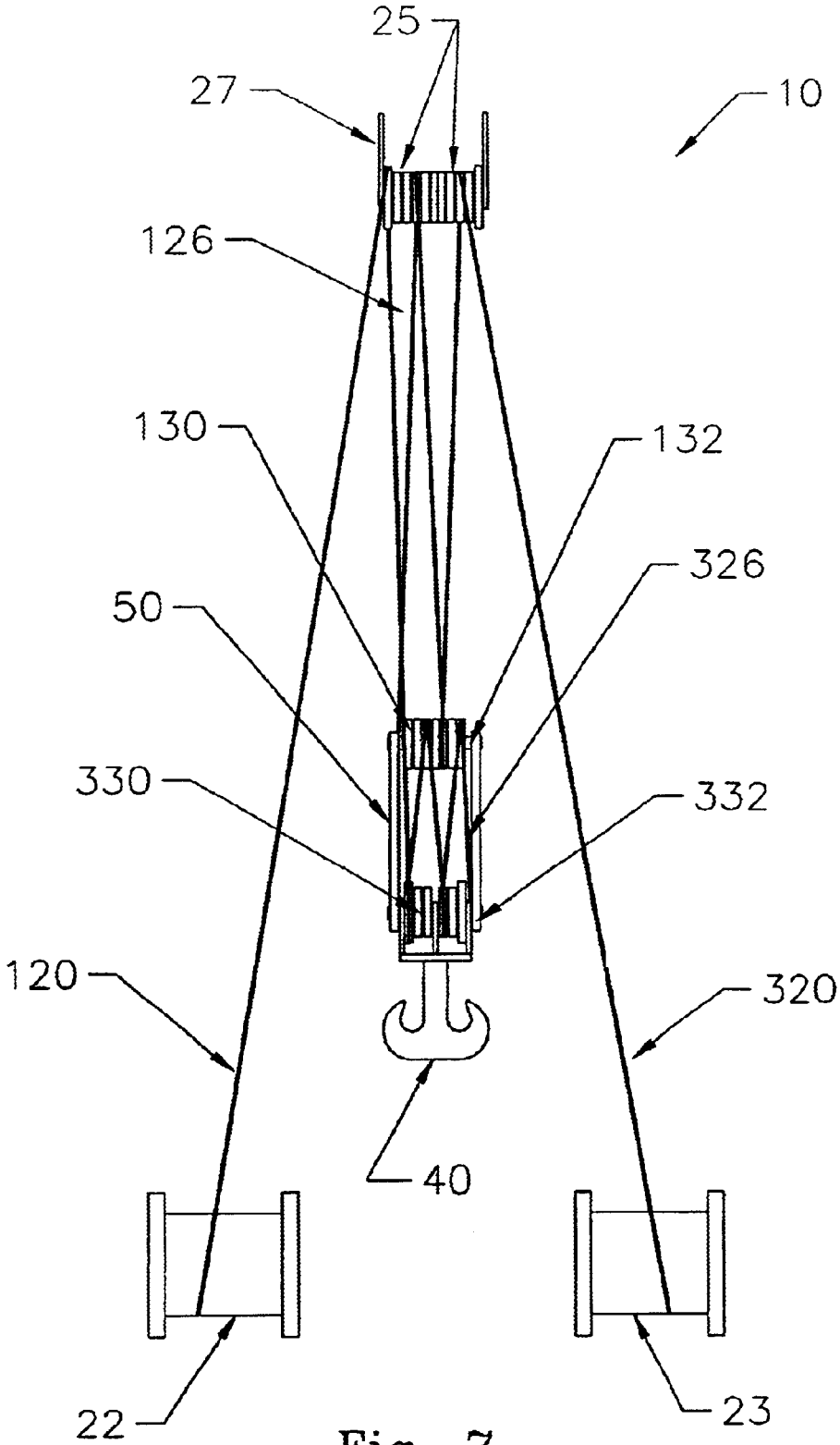
FIG. 7 depicts an alternative embodiment of the inventive single-line multiple-block reeving.

Alternatively, system 10 can use single load lines as depicted in FIG. 7. The rigging of upper reeving lines 126 and lower reeving lines 326 is analogous to that described in the preferred embodiment above. The alternative system 10 having single lines is typically used in the following examples. When loads being lifted by heavy crane 15 are relatively light, single lines of normal size and capacity reeving in moderate line parts numbers will drum around first winch drum 22 and second winch drum 23. If the length of boom 17 is short enough, a high number of parts of line in the reeving lines can be accommodated by the winch drums. If heavy capacity line is used, typically with a linear winch, a minimal number of parts of line in the reeving is required allowing long travel lengths of upper load block set 132 and lower load block 332.

OPERATION

Figure 4:
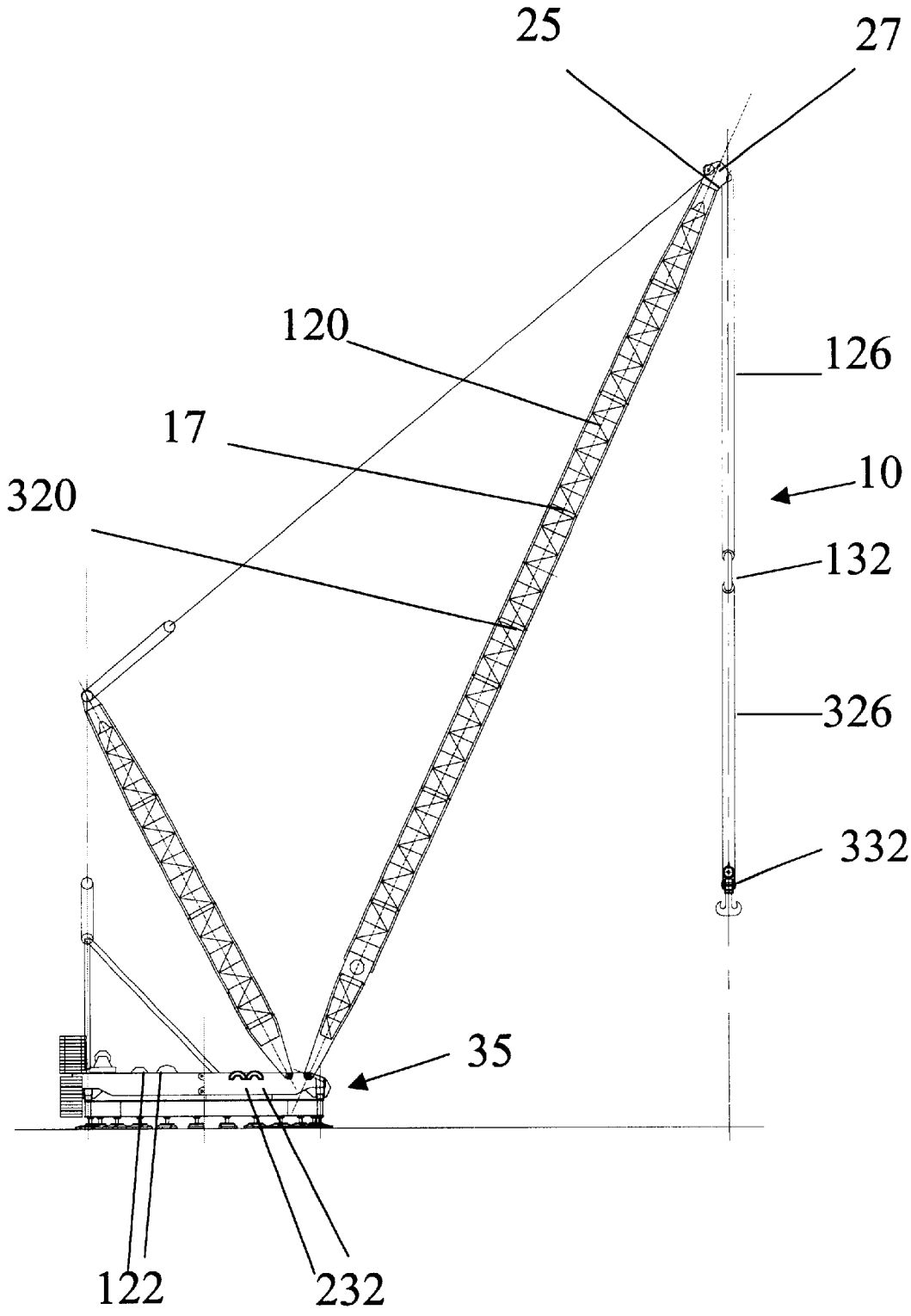
FIG. 4 depicts a heavy crane using the inventive multiple-line multiple-block reeving.

In the preferred embodiment shown in FIG. 4 and FIG. 5, hook 40 is raised and lowered by paying in and out upper load lines 120 and/or lower load lines 320. Upper load line 120*a* forms upper reeving lines 126*a*, while upper load line 120*b* forms upper reeving lines 126*b*. Upper reeving lines 126*a* and upper reeving lines 126*b* raise and lower upper load block set 132 at the same synchronized rate. To accomplish this synchronization in FIG. 5, left upper winch drum 122*a* and right upper winch drum 122*b* rotate such that upper load line 120*a* and upper load line 120*b* pay in and out at the same rate, assuming reeving and sheaves are equivalent.

Lower load lines 320 must likewise be coordinated to accomplish even movement of lower load block 332. To accomplish this synchronization, left lower winch drum 322*a* and right lower winch drum 322*b* must rotate such that lower load line 320*a* and lower load line 320*b* pay in and out at the same rate, assuming reeving and sheaves are equivalent.

In FIG. 5, when upper rigging unit 100 and lower rigging unit 300 have equivalent reeving, upper load block set 132 and lower load block 323 are each required to travel only half the total lift distance defined by the height of boom 17. The travel distance of each load block is determined by the amount of load line payed in and out to its associated reeving lines. Thus, each load line must only be long enough to afford travel distance half the height of the load lift height. Typically, to lower a load attached to hook 40, lower load block 332 is lowered by paying out lower load lines 320 until no more lower load line 320 is safely available, at which point upper load block set 132 is lowered by paying out upper load lines 120 until the load reaches the ground or other lower destination. To raise a load requires the reverse steps to be taken, although the opposite order may be used so long as the bounds of free travel of each load block set is not exceeded, resulting in unwanted contact between two load blocks.

In an alternative embodiment, upper reeving lines 126 and lower reeving lines 326 have a different number of reeving line parts. For example, the number of line parts in lower reeving lines 326 may be less than those found in upper reeving lines 126 or may be of different diameter or strength characteristics. This allows the upper load block set 132 and upper reeving lines 126 to have a higher lifting capacity and lower load block and lower reeving lines 326 to have a faster and greater range of motion, affording flexibility to the operator of heavy crane 15. When light lifting duties are required, lower reeving lines 326 and lower load block 332 will be run up and down at a resulting high speed, providing a good cycle time. When a heavy lift is required, upper load block set 132 is first lowered to the ground. Interconnecting steel link plates (not shown) mechanically then connect upper load block set 132 and lower load block 332, effectively bypassing the weak link when there are a smaller number of lines in lower reeving lines 326. The stronger and more numerous parts of line in upper reeving lines 126 are then used for the heavy lift. Load attachment hook 40 must therefore be of a capacity suitable for the heaviest duty to be performed in that configuration. Likewise, interconnecting steel link plates (not shown) can be used to mechanically connect upper load block set 132 and intermediate load block set 232, intermediate load block set 232 and lower load block 332, or any combination of connections affording the requisite circumvention of the weakest link of the rigging system having the smaller number and/or weaker lines.

In an alternative embodiment depicted in FIG. 6, system 10 comprises upper rigging unit 100, intermediate rigging unit 200 and lower rigging unit 300 as defined above. First winch drum 22 controls upper reeving lines 126, second winch drum 23 controls lower reeving lines 326, and third winch drum 19 controls intermediate reeving lines 226. First winch drum 22, second winch drum 23 and third winch drum 19 may operate in synchrony, independently or in a relative mode, as described below in the alternative embodiment depicted in FIG. 7. Operation is analogous to the embodiment described in FIG. 5, with the additional operation of intermediate rigging unit 200. For purposes of clarity, FIG. 6 depicts single line rigging units. It is understood, however, that in the preferred embodiment, upper rigging unit 100, intermediate rigging unit 200 and lower rigging unit 300 have multiple load lines, as depicted in FIG. 5.

In the alternative embodiment depicted in FIG. 7, first winch drum 22 and second winch drum 23 may operate in synchrony, independently, or in a relative mode. In FIG. 7, when the number of parts of line in upper reeving lines 126 and lower reeving lines 326 are equal, and upper load block sheaves 130 and lower load block sheaves 330 have equal diameters, the following occurs. If first winch drum 22 and second winch drum 23 are turning in synchrony, hook 40 travels twice as fast compared to a single winch drum turning at the same speed. If first winch drum 22 and second winch drum 23 operate independently, then the vertical travel rate of upper load block set 132 is linearly independent of lower load block 332. If first winch drum 22 and second winch drum 23 operate in a relative mode, upper load block set 132 and lower load block 332 move at vertical speeds relative to the relative speeds of first winch drum 22 and second winch drum 23. These conditions as described are representative of some of the many permutations available with different reeving, drums and sheaves. Many other permutations are obviously possible with different combinations of components described in system 10.

In the preferred embodiment, the winch drums and/or the load lines described in system 10 are of the same size and capacity. Thus, they are interchangeable between different cranes and rigging units. If additional capacity is required for a lift, then additional standard sized winch drums with standard size load line are added to heavy crane 15. This affords the option of additional parts of reeving lines, with the difference in lift distance required by the additional reeving being made up by the additional rigging units.

It is also understood that each rigging unit described above may have the same number of parts of reeving lines. The advantage afforded in this arrangement is that a higher lift height at high capacity (through a high number of reeving parts of line) can be provided economically with conventional sized winch drums and hoist lines. Each rigging unit is responsible for the vertical travel distance of a portion of the total vertical height of lift required.

It is further understood that while all embodiments are depicted as a vertical lifting device, the invention may also be utilized in a pulling device, either on an inclined plane or horizontally with the same benefits as described in the use with a crane or similar lifting device.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A multiple block system for a hoisting device for a load, comprising:

a boom head sheaving;

said boom head sheaving oriented generally above an upper rigging unit and a lower rigging unit;

said upper rigging unit oriented generally above said lower rigging unit;

an upper load block set;

said upper load block set having an upper load block upper sheaving and an upper load block lower sheaving;

said upper rigging unit comprising said upper load block upper sheaving, at least one upper load line and an upper reeving line termination point;

each said upper load line reeving around said boom head sheaving and said upper load block upper sheaving, attaching to said upper reeving line termination point and attaching to an upper load line winch;

a lower load block having lower load block sheaving;

said lower rigging unit comprising said upper load block lower sheaving, at least one lower load line and a lower reeving line termination point;

each said lower load line reeving around said boom head sheaving, said lower load block sheaving and said upper load block lower sheaving, attaching to said lower reeving line termination point and attaching to a lower load line winch;

said upper load line operable independently of said lower load line; and said lower load line operable independently of said upper load line.

2. A multiple block system as in claim 1, wherein said hoisting device is a crane.

3. A multiple block system as in claim 1, wherein said hoisting device is a pulling device for inclined planes through to the horizontal.

4. A multiple block system as in claim 1, further comprising at least one interconnecting steel link plate;

said at least one interconnecting steel link plate mechanically connecting said upper load block set and said lower load block, such that said at least one lower load line does not directly support said load.

5. A multiple block system for a hoisting device for a load, comprising:

a boom head sheaving, an upper rigging unit, at least one intermediate rigging unit and a lower rigging unit;

said boom head sheaving located generally above said upper rigging unit;

said upper rigging unit oriented generally above said at least one intermediate rigging unit;

said at least one intermediate rigging unit oriented generally above said lower rigging unit;

an upper load block set;

said upper load block set having an upper load block upper sheaving and an upper load block lower sheaving;

said upper rigging unit comprising said upper load block upper sheaving, at least one upper load line and an upper reeving line termination point;

each said upper load line reeving around said boom head sheaving and said upper load block upper sheaving and attaching to said upper reeving line termination point;

at least one intermediate load block set;

each said at least one intermediate load block set having an intermediate load block upper sheaving and an intermediate load block lower sheaving;

each said at least one intermediate rigging units comprising said intermediate lower load block upper sheaving, at least one intermediate load line and an intermediate reeving line termination point;

one of said intermediate load lines reeving around said boom head sheaving, one said intermediate lower load block upper sheaving and said upper load block lower sheaving of the next higher said intermediate load block set, attaching one of said intermediate reeving line termination points and attaching at least one intermediate load line winch;

other of said intermediate load lines reeving around said boom head sheaving, one said intermediate lower load block upper sheaving, and one said intermediate load block lower sheaving, attaching one of said intermediate reeving line termination points and attaching at least one intermediate load line winch;

said lower rigging unit comprising a lower load block including lower load block sheaving, at least one lower load line and a lower reeving line termination point;

each said lower load line reeving around said boom head sheaving, said lower load block sheaving and one said intermdeiate load block lower sheaving of lowest said intermediate load block set, attaching said lower reeving line termination point and attaching a lower line winch; and said upper load line, each said intermediate load line and said lower load line independently operable.

6. A multiple block system as in claim 5, wherein said hoisting device is a crane.

7. A multiple block system as in claim 5, further comprising at least one interconnecting steel link plate;

said at least one interconnecting steel link plate mechanically connecting one said intermediate load block set and said lower load block.

8. A multiple block system as in claim 5, further comprising at least one interconnecting steel link plate;

said at least one interconnecting steel link plate mechanically connecting said upper load block set and one said intermediate load block set.

9. A multiple block system as in claim 5, further comprising at least one interconnecting steel link plate comprising a first at least one interconnecting steel link plate and a second at least one interconnecting steel link plate; wherein said first at least one interconnecting steel link plate mechanically connecting said upper load block set and one said intermediate load block set; and said second at least one interconnecting steel link plate mechanically connecting one said intermediate load block set and said lower load block.

10. A multiple block system as in claim 5, further comprising a plurality of interconnecting steel link plates;

said plurality of interconnecting steel link plates selectively mechanically connecting said upper load block set to said top intermediate load block set, any of said intermediate load block sets to a subsequently lower intermediate load block set, and a lowest intermediate load block set and said lower load block.

11. A method of lifting a heavy load with a lifting device, comprising:

reeving a plurality of rigging units, each of said plurality of rigging units comprising a block sheaving and a set of reeving lines, said plurality of rigging units connected in series with a load suspended below said plurality of rigging units, said plurality of rigging units comprising a first rigging unit and at least one subsequent rigging unit, said first rigging unit having a greater number of line parts in said set of reeving lines than a first said subsequent rigging unit, each subsequent said subsequent rigging unit having a lesser number of line parts in said set of reeving lines from a preceding said subsequent rigging units;

lifting a lightest load by engaging said subsequent rigging unit having a smallest number of line parts in said set of reeving lines;

lifting subsequently a heavier load by mechanically connecting said preceding said subsequent rigging unit having a greater number of line parts in said set of reeving lines with said subsequent said subsequent rigging unit having a lesser number of line parts in said set reeving lines, and engaging said preceding said subsequent rigging unit having a greater number of line parts in said set of reeving lines; and lifting a heaviest load by mechanically connecting all of said subsequent rigging units and engaging said first rigging unit.

12. A method as in claim 11, further comprising:

providing a plurality of uniform length load lines and a plurality of uniform sized winch drums, wherein each of said plurality of uniform length load lines makes up each said set of reeving lines.

13. A method of lifting a heavy load with a lifting device, comprising:

reeving a plurality of rigging units, each of said plurality of rigging units comprising a block set and a set of reeving lines, said plurality of rigging units connected in series with a load suspended below said plurality of rigging units, said plurality of rigging units comprising a first rigging unit and at least one subsequent rigging unit, said first rigging unit having an equal number of line parts in said set of reeving lines to a first said subsequent rigging unit, each subsequent said subsequent rigging unit having an equal number of line parts in said set of reeving lines to a preceding said subsequent rigging units; and lifting a load by selectively engaging serially or concurrently said plurality of rigging units.

* * * * *